United States Patent [19]

Peng

[11] Patent Number: 4,776,746

[45] Date of Patent: Oct. 11, 1988

[54] HIGH-CAPACITY PARKING APPARATUS

[76] Inventor: Cheng-Hsien Peng, Fl. 2, No. 36, Chi Li 1 Street, 18 Lin, Fu Hsin Li, Chung Li City, Tao Yuan Hsien, Taiwan

[21] Appl. No.: 863,300

[22] Filed: May 15, 1986

[51] Int. Cl.[4] ..... E04H 5/38

[52] U.S. Cl. ..... 414/253; 414/259

[58] Field of Search ..... 414/253, 254, 255, 259, 414/257, 242, 260, 264, 277, 288, 661

[56] References Cited

U.S. PATENT DOCUMENTS

| | | | |
|---|---|---|---|
| 2,428,856 | 10/1947 | Sinclair | 414/259 |
| 2,751,093 | 6/1956 | Theibault | 414/259 |
| 3,018,903 | 1/1962 | Bianca | 414/264 |
| 3,990,589 | 11/1976 | Manaugh | 414/255 |
| 4,358,239 | 11/1982 | Dechantsreiter | 414/259 X |

FOREIGN PATENT DOCUMENTS

| | | | |
|---|---|---|---|
| 1192994 | 9/1960 | France | 414/253 |
| 551116 | 3/1955 | Italy | 414/264 |
| 8604107 | 1/1985 | PCT Int'l Appl. | 414/253 |
| 407519 | 8/1966 | Switzerland | 414/260 |

*Primary Examiner*—Peter A. Aschenbrenner
*Attorney, Agent, or Firm*—Erik M. Arnhem

[57] ABSTRACT

A high-capacity parking apparatus includes a multi-storyed garage designed in two opposite portions with a space therebetwen for installation of an elevator cage to move the car from an entry to, and unload it to an exit from, a respective parking division in the garage.

2 Claims, 6 Drawing Sheets

HIGH-CAPACITY PARKING APPARATUS

BACKGROUND OF THE INVENTION

One result of a fast booming economy in an urban area is that the population and the numbers of vehicles increase quickly. Further, many high buildings are also built in rapid succession. A conventional parking lot is normally not fully capable of handling the increased demand for vehicle parking space. Consequently, an uncontrolled parking state occurs: in a slow lane, in a lane of a street, and on a sidewalk. Thus traffic jam, arrive with vehicles and pedestrians are inconvenienced, especially during the so-called rush hours. The traffic jam condition not only jeopardizes traffic safety in a city but also impedes the control of traffic.

FIGS. 13 to 17 illustrates the prior art design of an elevator for moving a car. An associated hoist, while moving forward, generates a force F to drive the respective platform forward. The balance or equilibrium of the platform and the car thereon can be calculated with the following two formulae.

The sectional view A—A of FIG. 17 shows the backward movement of the platform subject to the force F.

| | | |
|---|---|---|
| $F(X) = Ma$ | $F = Ma = Wa/g$ | (1) |
| $To = 0$ | $Ws - FH\cos\theta = 0$ | (2) |
| | $s = H\sin\theta$ | |
| Solving (1) and (2), one gets | $a/g = \mathrm{Tan}0.1$ | |
| Let: $a = g/10$ | $\mathrm{Tan}\theta = 0.1$ | |
| $\theta = 5°43'$ | | |
| $h = H - H\cos\theta = H(1 - \mathrm{Cos}\theta) = .00497\ H$ | | |
| $s = H\sin\theta = .0996\ H$ | | |

The above values for O, h and s are based on the assumption of $a=g/10$. They are of considerable magnitude. In actual design, four rods are fixed to respective corners of the hoist and fixed at A and B to form a cantilever beam to resist the force F so that there is a bending stress on A by the torque of $M=FH=WH\ a/g$. Material at A tends to be subjected to fatigue stress and may fracture since its both sides are subjected alternatively to respective force. Therefore, in order to extend the service life, the values of a, H and W must be minimized to minimize the stress at A.

The smaller the value of a is, the greater will be the time required for parking and unloading; the a smaller value for H will increase the construction cost a smaller value of H will lead to a reduced capacity of the cage.

SUMMARY OF THE INVENTION

An intensive or high-capacity parking apparatus comprising a garage in the form of two opposite blocks with a space between them for installation of an elevator cage to move a car from an entry to a parking division in the garage, and unload the car at an exit from such a parking division.

BRIEF DESCRIPTION OF THE DRAWINGS

FIG. 4 is a plan view of the parking garage according to the present invention.

FIG. 7 is a section along line A—A in FIG. 6.

FIG. 8 is a view along line B—B in FIG. 1, showing the cage according to the present invention.

FIG. 9 is a view along line A—A in FIG. 8, showing the cage according to the present invention.

FIG. 10 is a top plan view along line C—C in FIG. 9.

FIG. 11 is an end view of several of the elements shown in FIG. 10.

FIG. 12 is a side elevation of several of the elements shown in FIG. 10.

FIG. 13 is an elevational view of a prior art apparatus.

FIG. 14 is a schematic plan view of the apparatus of FIG. 13.

FIG. 15 is an elevational view of a different prior art apparatus.

FIG. 16 is a schematic plan view of the apparatus of FIG. 15.

FIG. 17 is a schematic view along line A—a in FIG. 15.

DETAILED DESCRIPTION

1. Summary

Figure 1A:
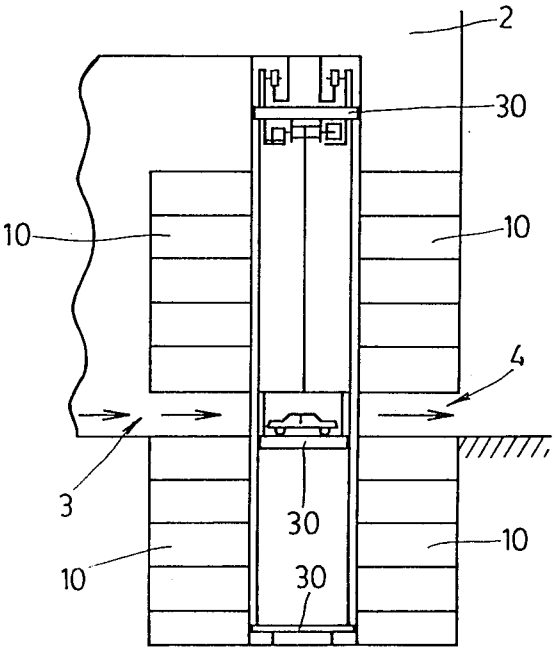
FIG. 1 is an elevational view of the present invention.
Figure 1:
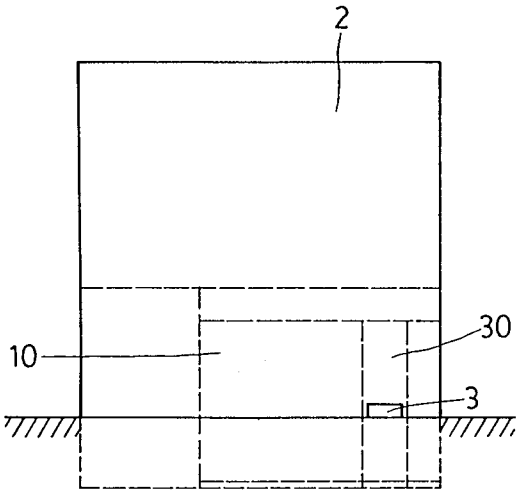
Figure 1C:
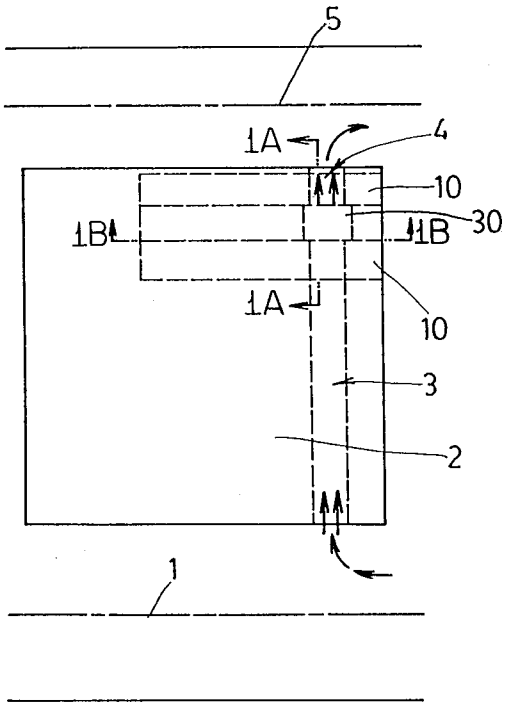
Figure 1B:
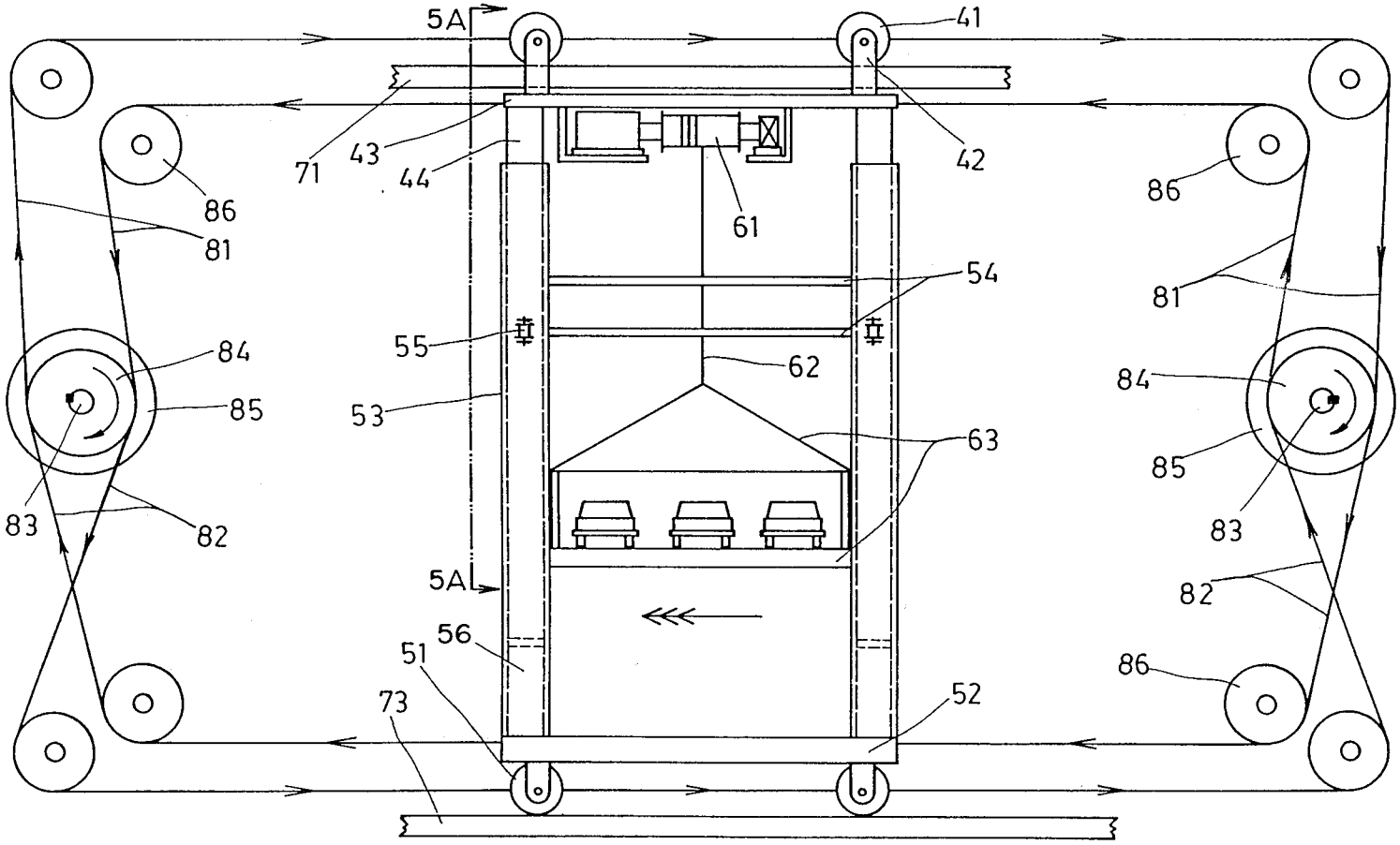
Figure 2A:
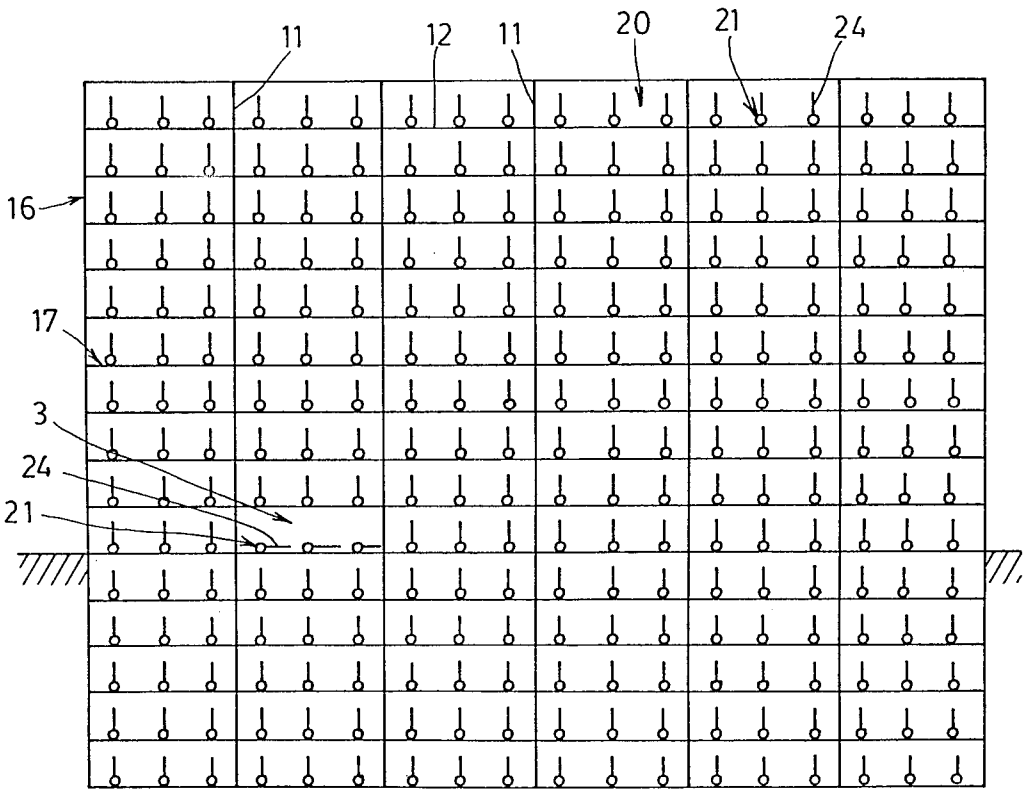
FIG. 2 is a plan view of the parking garage according to the present invention.
Figure 2:
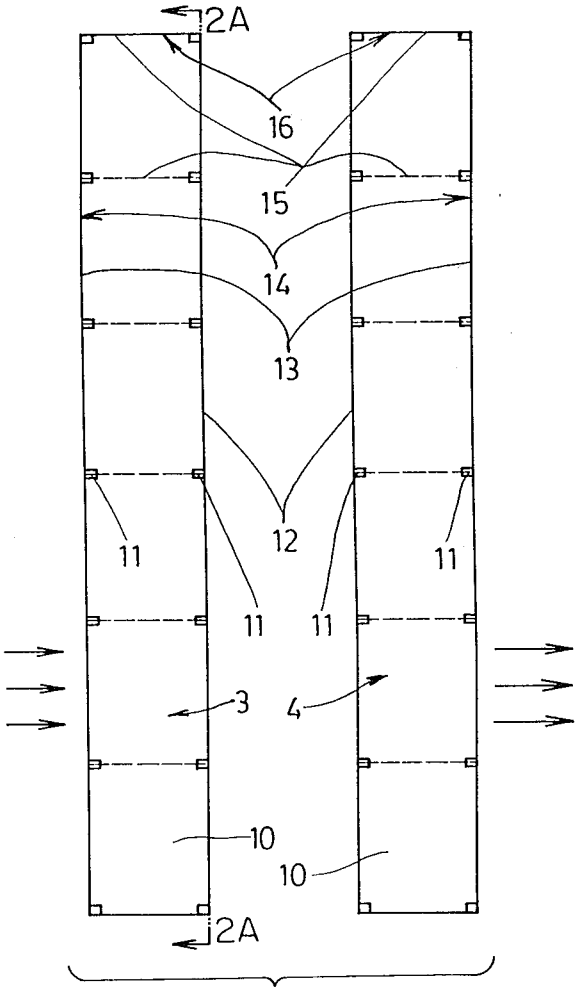

The present intensive parking apparatus is composed of two main parts, a multi-storeyed garage 10 and an elevator cage 30 (FIG. 1). The intensive parking apparatus requires only a small site. It can be a part of a building or it can be built separately. As shown in FIG. 2, it is in a building 02 between a road 01 and another road 05. It has a car passage 03 having a car exit 04. Garage 10 is composed of two opposite portions with a space inbetween for the installation of an elevator cage 30 to ease the entry and exit of cars. Upon reaching a designated position on the entry 03, driver must shift the transmission rod to the neutral position, turn wheel straightly forwards, stop engine without applying the hand brake, and close the doors/windows. He may leave after registering for parking. Then, an operator of the elevator cage can use a car pusher to push the car into the elevator cage 30 and then move the elevator cage to a desired position, and locate the car at a desired parking position. He can shift any car from any parking position to the exit for delivering it to the driver by operating in reverse procedures.

2. Garage

Figure 5B:
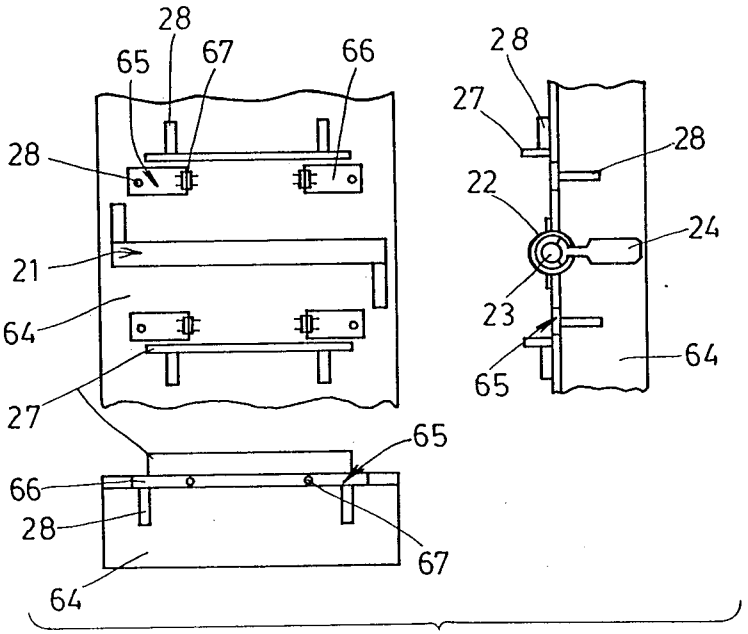
FIG. 5 is a view along line A—A in FIG. 4.
Figure 5A:
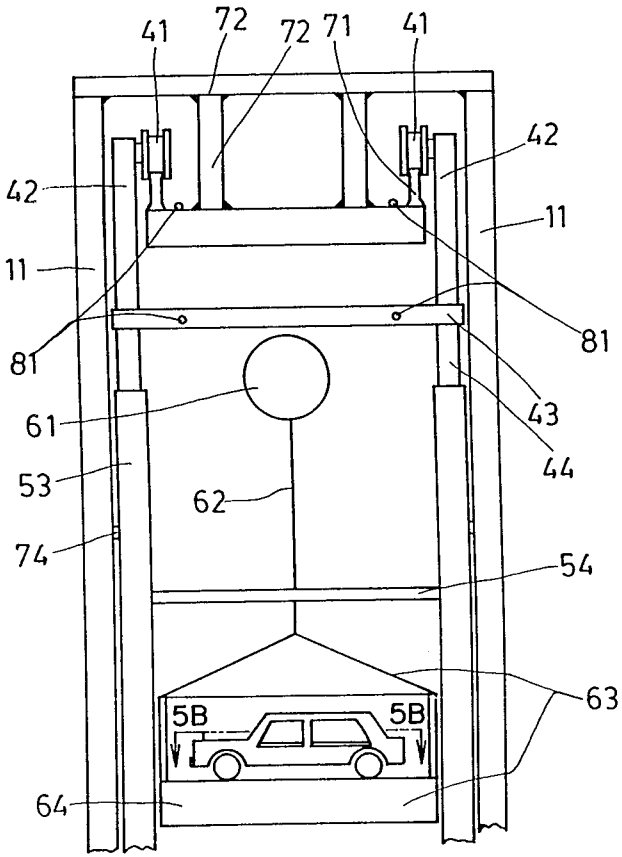

As shown in FIGS. 4 and 5, garage 10 is composed of two portions; each has 15 floors (10 floors above the ground and 5 floors under the ground); each floor is divided into six divisions for parking 530 cars in totals. The garage 10 comprises a plurality of rectangular parking divisions 20, each of which is built with a plurality of inner and outer columns 11, a plurality of inner beams 12, a plurality of outer beams 13, two outer walls 14, a plurality of transverse beams 15, four side walls 16 and a plurality of floors 17. The garage 10 is in a form of two opposite portions with a space inbetween having a width of approximately 1.5 times of the average length of a car. Every two consecutive inner columns form a parking division.

In addition to the basic requirements for its construction, the parking division has to be equipped with parking facilities. Each parking position for a car must be equipped with a car pusher 21.

Figure 6A:
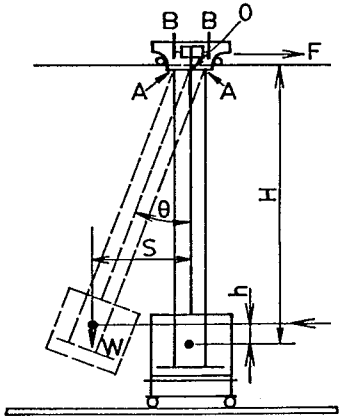
FIG. 6 is a plan view of a parking division and showing a car pusher according to the present invention.
Figure 6:
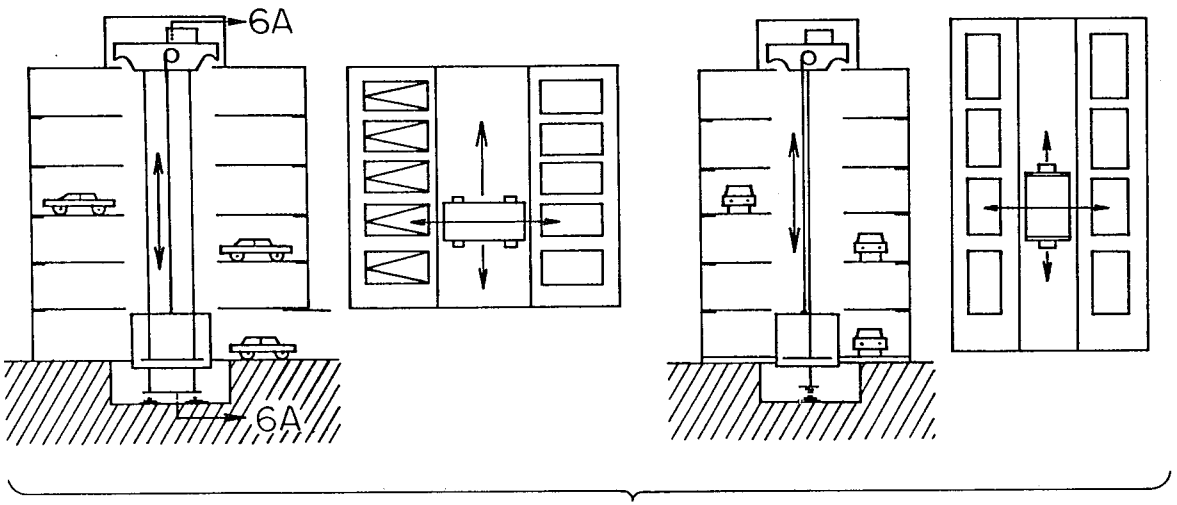

The car pusher 21 comprises a housing 22 having a guide channel, a threaded rod 23, a pushing piece 24 which is composed of a circular nut and a plate, and a reversible motor 25 as illustrated FIGS. 6 and 7. Moreover, each parking position has to be equipped with two stoppers 26, two wheel guide frames 27 and four pneumatic cylinders 28.

Figure 3A:
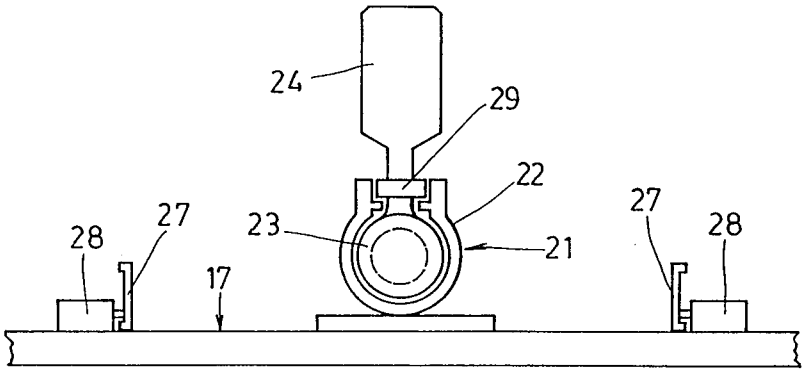
FIG. 3 is a section along line A—A in FIG. 2 of the parking garage according to the present invention.
Figure 3:
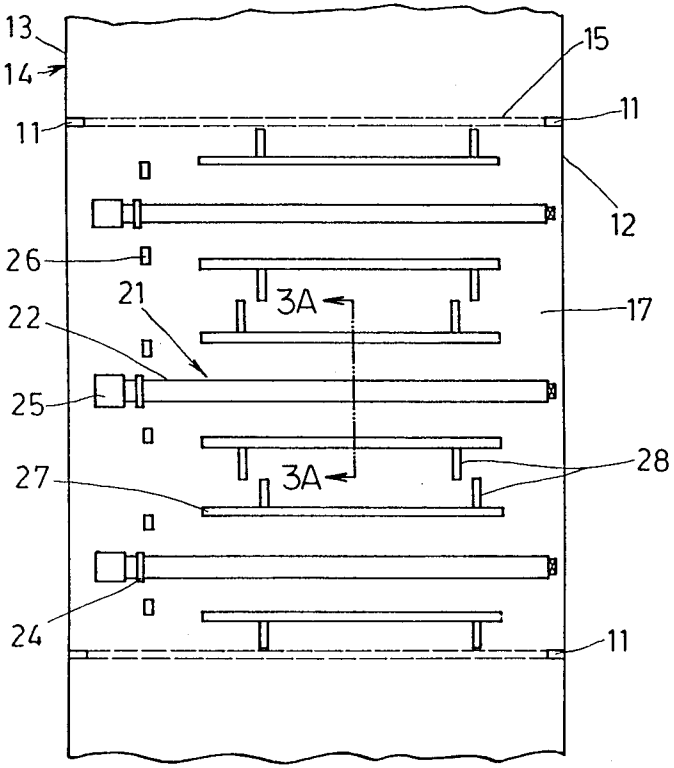

Since threaded rod 23 has a relatively large length, if it is only supported at the two ends thereof, the deflection by its own weight will be relatively large. It will result in that the nut of the pushing piece 24 cannot get itself through the guide channel of the housing 22 around the center of the threaded rod 23 which can be dealt with by the following measures:

(a) For reducing the weight thereof, the threaded rod 23 is made of a tube;

(b) The threaded rod 23 is supported by two bearings at each of its two opposite end portions with the inner one being a ball bearing and the outer one being a tapered roller bearing. Being so supported, the threaded rod 23 can be approached by a fixed beam and its deflection will only be one fifth of that of a simple beam; and (c) Before connecting the plate and the nut of the pushing piece 24 together, a specially designed bearing 29 is mounted inbetween for the purpose of transmitting the weight and the load of the pushing piece 24 to the housing 22, as shown in the A—A sectional view of FIG. 3. After the threaded rod 23 is dealt with the above three measures, pushing piece 24 will be smoothly and reciprocally movable on the channel of housing 22.

After the cage 30 reaches to a desired parking division 20, the car in the cage 20 will be pushed out by the car pusher 21. While the car pusher 21 is driven back and forth, the car will be accelerated till it reaches the stoppers 26 so that an appropriate distance can be maintained between the car and the cage 30 without the car interfering the operation of the cage 30. Since the pushing piece 24 of the car pusher 21 is in contact with the front or rear bumper of the car for moving the car to a parking position, an oblique bumper will cause an oblique movement of the car and consequently, may cause the car to collide with other cars. Therefore, wheel guide frames 27 are used to prevent the car from an excessive oblique movement. Furthermore, the wheels of the car must be straightly forward at the parking position; otherwise, it will be hard to push again. Therefore, after the car is parked, four pneumatic cylinders 28 on the wheel guide frames 27 will apply a force to keep the car stable and to prevent the car from moving till the need for the delivery of the car is discharged. For delivering the car, the pneumatic cylinders 28 must be retracted first, and the motor 25 drives the pushing piece 24 forward along the guide channel on the housing 22 by means of the engagement between the nut on pushing piece 24 and the threaded rod 23 in order to push the car into the cage 30. Then, a micro switch triggered by the pushing piece 24 when reading a predetermined position will turn the rotating direction of the motor 25 so that the pushing piece 24 can return to its original position.

Facilities at the entry 03 are similar to those at the parking division 20 except that there must be an opening at the rear end of the guide channel on the housing 22 of the car pusher 21. It will turn 90° automatically after the pushing piece returned to its original position so that the car can move across it to the entry position 03. The guide frames 27 at the entry 03 are pneumatically operated by means of the pneumatic cylinders 28. Facilities at the exit 04 are similar to those at the parking division 20 except that there is no car pusher 21 and the guide frames 27 are manually operated.

3. Elevator Cage

As shown in FIGS. 8 to 12, the elevator cage 30 is composed of an upper cage 40, a lower cage 50, an elevator 60, a rails 70 and a transmission system 80, as described below:

The upper cage 40 comprises a set of rollers 41 (four of which are illustrated in the drawings), a set of links 42, a frame 43, a set of cylinders 44 (four of which are illustrated in the drawings). The lower cage 50 also comprises a set of rollers 51 (four of which are illustrated in the drawings), a frame 52, a set of cylinders 53 (four of which are illustrated in the drawing) and a plurality of tie plates 54, a plurality of side rollers 55, and a set of hydraulic cylinders 56 (four of which are illustrated in the drawings). Structure of the elevator 60 is similar to that of a standard elevator. A winch 61 is fixed to the bottom of the frame 43, with a cable having its lower end fixed to a carrier 63 which is composed of a plateform 64, a plurality of car pusher 21, a plurality of car holder 65, and a plurality of wheel guide frames 27. The car pusher 21 and wheel guide frame 27 are the same as those used in the entry 03. The car holder 65 comprises 4 holding plates 66, 4 hinges 67, and 4 pneumatic cylinders 28. The rail 70 comprises two upper rails 71, a plurality of support brackets 72, two lower rails 73 and a plurality of side rails 74. The transmission system 80 comprises two upper traction cables 81, two lower traction cables 82, two driving shafts 83, eight traction wheels 84, two brakes 85 and 16 idlers 86.

The two upper rails 71 are supported by the support brackets 72 as shown in the sectional view A—A of FIG. 9. The support brackets 72 are supported by the inner column 11 so that the link 42 and the rollers 41 can bear all the load from the upper cage 40 and the elevator 60. The rollers 51 can bear all the load from the lower cage 50. The upper cage 40 has its cylinders 44 inserted and positioned in the hollow cylinders 53 of the lower cage 50 with a reserved space filled with hydraulic oil to form a hudraulic cylinder 56. Therefore, the upper cage 40, the elevator 60 and the lower cage constitute an assembly which can travel along the upper rails 71 and the lower rails 73 freely. Since the cage 30 has a height equal to several times of its length, it will swing at high speed. Therefore, a plurality of side rails 74 are installed along the inner beams 12 and also the side rollers 55 on the cylinder 53 to prevent it from swinging. One end of the upper traction cable 81 is fixed to one end of the frame 43. An upper traction cable 81 is connected to the left side and another one to the right side of the frame 43. Each traction cable 81 passes through an idler 86 at one side of the frame 43, around a traction wheel 84 for several turns, through another idler 86, a smaller roller (not indicated in the drawings) on the support bracket 72, through an idler 86 at another side, around another traction wheel 84 for several turns, and through another idler 86 and finally fixed to another end of the frame 43. In the same manner, a lower traction cable 82 is connected to the left side and another to the right side of another cage frame 52 after winding around a traction wheel 84 for several turns. Whenever the two driving shafts 83 are rotating clockwise simultaneously, four traction wheels 84 at the shafts rotate accordingly to shorten the traction cables 81/82 at the left side and lengthen the right traction cables. As soon as the cage 30 reaches a desired parking division, the power supplied to the driving shafts 83 is cut off and the brakes 85 function to stop the traction wheels 84. Whenever the driving shafts 83 are rotating counterclockwise simultaneously, the cage 30 is moved from the left to the right side. The car from the entry 03 or the parking division 20 to the carrier 64 can only reach its edge and must be adjusted there. Therefore, the car holder 65 must be equipped there. After entering the platform 64, the rear wheels of the car are on the holding plates 66 at the entry end. Four pneumatic cylinders 28 beneath them are operated simultaneously to lift up the holding plates 66 in order to turn the holding plates 66 for a certain degree with the hinge 67 as a pivot. Then, because of the gravity, the wheels of the car will move to and fro on the floor of the carrier 63 several times till a balance is reached. The holding plates 66 is kept stable, and pneumatic cylinders 28 on the wheel guide frame 27 are operated simultaneously to clamp the car on the platform 64 till the car is delivered. After the car is clamped and held, the car is moved to a desired parking division 20. After reaching at the desired parking division 20, the cage 30 is kept stable by the elevator 60. Before unloading the car, the pneumatic cylinders 28 on the wheel guide frames 27 are retracted to their original positions. The car pusher 21 is then operated to push the car to leave the carrier at a small acceleration toward a parking position in the parking division 20 till it reaches the stoppers 26. Then, the pneumatic cylinders 28 on the wheel guide frames 27 are operated automatically so that the car is clamped by the wheel guide frames 27 on a parking position in the parking division 20 till it is discharged.

A considerable time is required for travelling the cage 30 at a low speed, but for a high speed moving, a high center of gravity, or a great difference between the upper and lower rollers required traction forces will cause irregular movement of the cage. If the travelling distance is short, low speed travelling is preferable. In case there are many parking divisions 20 in the garage 10 for the purpose of reducing cost, high speed or medium speed travelling under the following situation can be applied.

In a large-scale park, the cage 30 must travel at a high or medium speed. Since the elevator 60 is fixed to the frame 43, the total weight of the cage 40 and the elevator 60 is greater than the weight of the cage alone.

Let:

$W_1$=Static load on the upper roller (lb)

$W_2$=Static load on the lower roller (lb)

a=Acceleration of the cage (ft/sec$^2$)

$F_1$=External force required for the travelling of the upper cage $F_2$=External force required for the travelling of the lower cage The friction generated during travelling is neglected since it is very small.

Then:

$$F_1=W_1a/g; \qquad F_2=W_2a/g$$

Therefore:

$$F_1-F_2=(W_1-W_2)a/g$$

Assumed:

| | |
|---|---|
| $W_1$ = 36,000 lbs, | $W_2$ = 24,000 lbs, |
| a = g/10, | f = $F_1$ − $F_2$ |

Then:

$$F_1=36{,}000\times g\div 10\div g=3{,}600 \text{ lbf.}$$

$$F_2=24{,}000\times g\div 10\div g=2{,}400 \text{ lbf.}$$

$$f=3{,}600-2{,}400=1{,}200 \text{ lbf.}$$

The above analysis discloses that the difference between the traction forces $F_1$ and $F_2$ of the upper and the lower traction cables 81 and 82 is f, which is approximately 50% of $F_2$. However, the upper and lower traction cables are driven by the driving shaft 83 and the distribution of force thereof is not even. The unevenness will cause a great vibration of and damage to the system. The only solution to this problem is to minimize the value of a till no vibration is reduced to zero. However, the smaller the value of a, the greater will be the time of cage travelling. This is not a solution that meets our requirements.

An alternative way is to use a small oil pump for adjusting the pressure of the hydraulic cylinders 56 so that $W_1=W_2$. Then, $f=F_1-F_2=0$, and $F_1=F_2$. And then, the value of a will not be limited by unevenness of the force distribution. However, the value of a should not be too large since the distance of travel is short and the volume and weight of the cage is great. A value between g/10 and g/8 is recommended.

The center of gravity of the cage is near the platform 63. Since $F_1=F_2$, it is preferable to have the center of gravity in the middle of upper and lower traction cables 81 and 82. However, in consideration of the difficulty in underground excavation, and for the quality of high speed travelling, the center of gravity of the cage may be placed at a point between one third and one half of the overall height of the cage. The present invention can adapt to a computerized operation with a minimum number of operators.

I claim:

1. A parking apparatus comprising:

a multi-storeyed garage structure with a first portion having a plurality of parking stalls and a second plurality of parking stalls spaced apart from said first portion to leave a space therebetween, said second portion having a plurality of parking stalls, with at least some parking stalls in each portion of said structure facing each other; and said structure having at least an entry enabling at least one car to be ready to be moved into said garage structure;

an exit positioned opposite to said entry, for enabling said at least one car to be delivered to a driver from said garage structure;

an elevator cage installed in the space between said first and second portions for moving said car to and unloading it from one of said parking stalls in said garage structure and including:

a first set of rails mounted at said garage structure at the top of said space;

an upper frame secured at said first set of rails and having a first plurality of cylinder members;

a second set of rails mounted at said garage structure at the bottom of said space;

a lower frame riding on said second set of rails and having a second plurality of cylinder members, with each of said second cylinder members being associated with a respective first cylinder member in a sleeving relationship, but reserving therebetween a room filled with a fluid to perform hydraulic cylinder functions thereat for adjusting and balancing the loads at said upper and lower frames respectively;

an elevator, suspended at said upper frame, for selectively elevating said at least one car to any story of said garage; and a transmission system, said transmission system having a plurality of traction cables connected to said upper and lower frames, a plurality of traction wheels, and a plurality of idlers, with said traction cables being arranged on said traction wheels and said idlers that when said traction wheels are rotated in a first direction, said frames move along said rails from the right to the left, when considered in the longitudinal direction of said space, and when rotated in the opposite second direction, said frames move from the left to the right.

2. A parking apparatus according to claim 1, wherein said elevator includes a car pusher with:

i. a housing providing a guide channel and for receiving therein a threaded rod;

ii. a threaded rod arranged in said housing and having an effective length in excess of the overall length of said at least one car, and adapted to be driven by a reversible motor;

iii. a circular nut installed between said threaded rod and said housing;

iv. a pushing plate secured to said nut and by which said at least one car can be pushed when said threaded rod is driven; and v. a reversible motor operatively connected to said threaded rod.

* * * * *